US012252962B2

(12) United States Patent
Karakaya et al.

(10) Patent No.: US 12,252,962 B2
(45) Date of Patent: Mar. 18, 2025

(54) SHOCK-WAVE GENERATION FOR WIRELINE

(71) Applicant: Saudi Arabian Oil Company, Dhahran (SA)

(72) Inventors: Mustafa Karakaya, Dhahran (SA); Sohrat Baki, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/450,728

(22) Filed: Aug. 16, 2023

(65) Prior Publication Data

US 2025/0059858 A1 Feb. 20, 2025

(51) Int. Cl.
*E21B 43/117* (2006.01)
*E21B 43/116* (2006.01)
*E21B 43/119* (2006.01)

(52) U.S. Cl.
CPC ..... *E21B 43/116* (2013.01); *E21B 43/119* (2013.01)

(58) Field of Classification Search
CPC .... E21B 31/1075; E21B 29/02; E21B 43/117; E21B 43/116
See application file for complete search history.

(56) References Cited

U.S. PATENT DOCUMENTS

| | | | | | |
|---|---|---|---|---|---|
| 2,177,886 | A * | 10/1939 | Halliburton | E21B 31/002 | 166/178 |
| 2,187,007 | A * | 1/1940 | Barnes | E21B 17/023 | 166/241.5 |
| 2,980,017 | A * | 4/1961 | Castel | E21B 43/117 | 175/4.6 |
| RE25,407 | E * | 6/1963 | Lebourg | F42D 1/05 | 175/4.6 |
| 3,713,484 | A | 1/1973 | Gray | | |
| 6,672,405 | B2 | 1/2004 | Tolman et al. | | |
| 8,851,191 | B2 | 10/2014 | Mhaskar et al. | | |
| 9,752,406 | B2 | 9/2017 | Hardesty et al. | | |
| 2003/0075328 | A1 * | 4/2003 | Challacombe | E21B 43/263 | 166/299 |
| 2012/0298361 | A1 | 11/2012 | Sampson | | |
| 2016/0115753 | A1 | 4/2016 | Frazier et al. | | |
| 2016/0168961 | A1 | 6/2016 | Parks et al. | | |
| 2017/0175474 | A1 | 6/2017 | Marcantel et al. | | |

* cited by examiner

*Primary Examiner* — Kipp C Wallace
(74) *Attorney, Agent, or Firm* — Fish & Richardson P.C.

(57) ABSTRACT

A wireline perforation assembly configured to be disposed in a wellbore includes one or more perforation gun subassemblies, each comprising one or more shaped explosive perforation charges configured to, when detonated, form a perforation in a wall of the wellbore. The assembly further includes shock-wave generation subassemblies, each comprising a housing and a length of detonation cord within an interior volume defined at least in part by the housing, the housing at least partially isolating the length of detonation cord from the perforation gun subassemblies and configured such that a detonation of the detonating cord within the interior volume generates shock waves and does not cause detonation of any shaped explosive perforation charges.

21 Claims, 7 Drawing Sheets

SHOCK-WAVE GENERATION FOR WIRELINE

TECHNICAL FIELD

The present disclosure is directed to a method and apparatus for dislodging stuck downhole wireline assemblies. More particularly, embodiments of the present disclosure relate to the use of a wireline sub comprising detonating cord or another explosive material to generate shock waves to facilitate such dislodgement.

BACKGROUND

During the completion of wellbores and other activities related to subsurface production of oil, gas, and other subsurface materials, downhole apparatus such as wireline-conveyed perforating tools can become wedged or otherwise stuck within a wellbore. Various jars and other devices have been employed to extricate (unstick or free) such wireline tools so that they can be retrieved or otherwise move uphole or downhole within the wellbore.

SUMMARY

Certain aspects of the subject matter herein can be implemented as a wireline perforation assembly configured to be disposed in a wellbore. The assembly includes one or more perforation gun subassemblies, each comprising one or more shaped explosive perforation charges configured to, when detonated, form a perforation in a wall of the wellbore. The assembly further includes shock-wave generation subassemblies, each comprising a housing and a length of detonation cord within an interior volume defined at least in part by the housing, the housing at least partially isolating the length of detonation cord from the perforation gun subassemblies and configured such that a detonation of the detonating cord in the shock-wave generation subassembly generates shock waves and does not cause detonation of any shaped explosive perforation charges.

An aspect combinable with any of the other aspects can include the following features. The assembly can be configured such that shock waves generated by the detonation of the detonating cord in the shock-wave generation subassembly dislodges the assembly from a stuck position in the wellbore.

An aspect combinable with any of the other aspects can include the following features. The length of detonation cord within the interior volume can be a helical spiral of detonation cord.

An aspect combinable with any of the other aspects can include the following features. The one or more perforation gun subassemblies and the shock-wave generation subassemblies can be threaded subs.

An aspect combinable with any of the other aspects can include the following features. The housing can be substantially cylindrical and an outer diameter of the housing can be substantially the same as the diameter of the one or more perforation gun subs.

An aspect combinable with any of the other aspects can include the following features. The wireline perforation assembly can further include a detonator configured to, in response to a control signal, detonate the detonating cord in at least one of the one or more shock-wave generation subassemblies, without detonating any of the one or more shaped explosive perforation charges.

An aspect combinable with any of the other aspects can include the following features. The length of detonating cord in the shock-wave generation subassembly can be a first length of detonating cord, the detonator can be a first detonator, and the control signal can be a first control signal, and at least one of the perforation gun subassemblies can further include a second length of detonating cord and a second detonator. The second detonator can be configured to, in response to a second control signal, detonate the second length of detonating cord, thereby detonating at least one of the one or more shaped explosive perforation charges.

An aspect combinable with any of the other aspects can include the following features. An uphole end of the assembly can be configured to be attached to a wireline conveyance.

Certain aspects of the subject matter herein can be implemented as a shock-wave generation sub. The sub includes an uphole end and a downhole end, at least one of the uphole end or the downhole end attachable to a perforation gun subassembly of a wireline perforation assembly. The wireline perforation assembly is configured to be disposed in a wellbore and the perforation gun subassembly comprising one or more shaped explosive perforation charges configured to, when detonated, form a perforation in a wall of the wellbore. The sub also includes a housing defining an interior volume; and a a length of detonation cord within the interior volume. The housing at least partially isolates the length of detonation cord from the perforation gun subassembly. The shock-wave generation sub is configured such that a detonation of the detonating cord in the shock-wave generation subassembly generates shock waves and does not cause detonation of any shaped explosive perforation charges.

An aspect combinable with any of the other aspects can include the following features. The uphole end or the downhole end can be threaded and the perforation gun subassembly can be a threaded perforation gun sub.

An aspect combinable with any of the other aspects can include the following features. The shock-wave generation sub can be configured such that shock waves generated by the detonation of the detonating cord in the shock-wave generation sub can dislodge the wireline perforation assembly from a stuck position in the wellbore.

An aspect combinable with any of the other aspects can include the following features. The length of detonation cord within the interior volume can be a helical spiral of detonation cord.

An aspect combinable with any of the other aspects can include the following features. The housing can be substantially cylindrical and an outer diameter of the shock-wave generation sub can be substantially the same as an outer diameter of the perforation gun subassembly.

An aspect combinable with any of the other aspects can include the following features. The shock-wave generation subassembly can include a detonator configured to, in response to a control signal, detonate the detonating cord, without detonating any of the one or more shaped explosive perforation charges.

Certain aspects of the subject matter herein can be implemented as a method. The method includes detonating one or more shaped explosive perforation charges of a wireline perforation assembly positioned within a wellbore via a wireline conveyance, thereby forming a perforation in a wall of the wellbore, and detonating, in response to an indication that the wireline perforation assembly is in a stuck position in the wellbore, a length of detonation cord within an interior volume of a shock-wave generation subassembly that is a component of the wireline perforation assembly, the shock-wave generation subassembly including a housing at least partially isolating the length of detonation cord within the interior volume, thereby generating shock waves without detonating any shaped explosive perforation charges of the wireline perforation assembly.

An aspect combinable with any of the other aspects can include the following features. The shock waves free the wireline perforation assembly from the stuck position.

An aspect combinable with any of the other aspects can include the following features. The length of detonation cord within the interior volume can be a helical spiral of detonation cord.

An aspect combinable with any of the other aspects can include the following features. The method can further include retrieving the assembly with the wireline conveyance after detonating the length of detonation cord within an interior volume.

An aspect combinable with any of the other aspects can include the following features. The shock-wave generation subassembly can be a first shock-wave generation subassembly, the wireline perforation assembly further can be a second shock-wave generation subassembly, the indication can be a first indication that the wireline perforation assembly is in a stuck position in the wellbore, and the detonating of the detonation cord within the shock-wave generation subassembly can be a first instance of detonation of detonation cord in a shock-wave generation subassembly. The method can further include detonating, as a second instance of detonation of detonation cord and in response to a second indication that the wireline perforation assembly is in a stuck position in the wellbore, a length of detonation cord within an interior volume of the second shock-wave generation subassembly, thereby generating further shock waves without detonating any shaped explosive perforation charges.

An aspect combinable with any of the other aspects can include the following features. The method can further include detonating one or more shaped explosive perforation charges after the second instance of detonation of detonation cord in the second shock-wave generation subassembly.

An aspect combinable with any of the other aspects can include the following features. The first instance of detonating can be by a detonator within the first shock-wave generation subassembly and the second instance of detonating can be by a detonator within the second shock-wave generation subassembly.

DETAILED DESCRIPTION

Figure 1A:
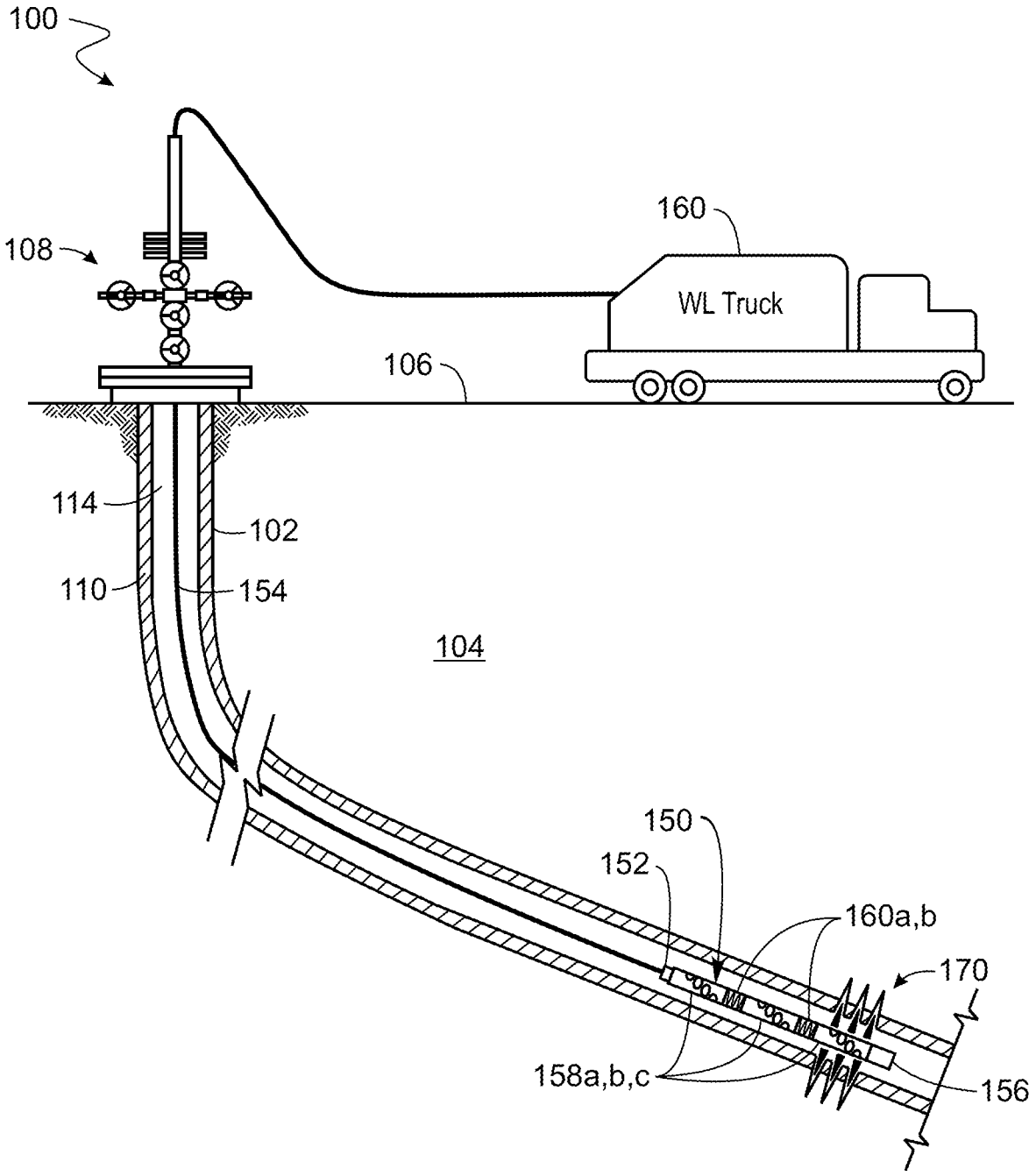
FIGS. 1A-1D are a schematic illustrations of a wellbore system in accordance with some embodiments of the present disclosure.

During well operations, such as wireline perforating operations, a wireline bottomhole can become stuck or lodged in the wellbore such that further uphole or downhole movement is prevented or constrained. Such sticking can occur due to accumulated debris at lateral section of the wellbore, deformation of perforation/lateral area, plug size enlargement, or wellbore diameter changes.

In accordance with embodiments of the present disclosure, detonating cord or another explosive material can be pre-installed in dedicated subassemblies of the wireline assembly. The explosive material can be selectively detonated via control signals from the surface. independent switches and detonating system and if require selectively fire from wireline truck at surface. The detonation generates shock waves which can dislodge the assembly, allowing it to be freed from the stuck position. The shock-wave subassembly can be configured such that a detonation does not interfere with other wellbore operations. For example, the shock-wage generation subassembly can be included as part of a wireline perforation assembly and can be configured such that detonation of the dedicated shock-wave generation charges not cause detonation of any perforation charges.

The present disclosure can provide a solution that is simple and cost-effective. For example, the shock-wave detonation subassemblies can be installed on a wireline perforation assembly and activated (as may be necessary) on the same trip as the perforation operations, by an operator using the same control system used to activate the perforation charges, with the signals conveyed via (for example) dedicated separate electrical wire connections in the wireline conveyance, from the same wireline truck at the surface. Multiple shock-wave generation subassemblies can be included in a single wireline assembly, each with a separate detonator, allowing selective detonation and shock-wave generation operations as selectively initiated by the operator as necessary. Shock wave sub cage can be used repeatedly, with repeated use requiring only limited remedial steps such as the changing of elastomer seals and detonating cords. The shock-wave generation subassemblies can be in the form of short threaded subs having the same or similar diameter and dimensions as the other subs of the assembly, facilitating efficient downhole movement of the assembly using conventional wireline equipment and allowing the use of common assembly and disassembly equipment.

FIGS. 1A-1D are schematic illustrations of a well system in accordance with an embodiment of the present disclosure. Well system 100 includes a wellbore 102 drilled into a subterranean zone 104 from surface 106. Wellbore 102 can be a wellbore of an oil and/or gas well, water well, or other wellbore drilled into subterranean zone 104 for purposes of oil and/or gas production or other purposes or applications, and can be drilled from a surface (land) location or an offshore location. Wellbore 102 in the illustrated embodiment is substantially vertical; however, in some embodiments the wellbore can include both vertical and other-than-vertical (such as substantially horizontal) portions, and can comprise a single wellbore or can include multiple lateral wellbores. Well system 100 further includes a wellhead 108, which can include various spools, valves, and adapters to provide pressure and flow control from wellbore 102.

In the illustrated embodiment, casing 110 has been installed and cemented in place within wellbore 102 to stabilize the wellbore in accordance with conventional methods. Wellbore 102 can be filled by a wellbore fluid 114, such as produced fluids, completion fluids, or another suitable fluid or mixture of fluids.

Well system 100 further includes wireline perforation assembly 150 attached via a neck at its uphole end 152 to a wireline conveyance 154, which can include one or more electric cables through which an electric current or signals can be transmitted to or from a wireline control system 160, which in the illustrated embodiment is a wireline truck at a location on surface 106. In other embodiments, some or all of wireline control system 160 can be located at another surface or downhole location.

Wireline perforation assembly 150 includes one or more perforation gun subassemblies 158*a*, 158*b*, and 158*c*, each comprising one or more shaped explosive perforation charges, and shock-wave generation subassemblies 160*a* and 160*b*. These subassemblies and their function are described in greater detail below. Wireline perforation assembly 150 can include further components including some or all of isolation plug 156 at its downhole end, tandem isolation subs, plug-shoot adapters, quick change sub, transfer module subs, transfer booster kits, time delay systems, percussion initiators, and weight bars.

Perforation gun assemblies 158*a*, 158*b*, and 158*c* can be configured such that, when detonated, the shaped explosive charges form a perforations 170 through the casing 110 and through a wall of the wellbore, as shown in FIG. 1A. Perforations 170 provide a pathway for oil, gas, or other materials to be produced from subterranean zone 104 to enter wellbore 102. Instead of or in addition to explosive charges, the perforation gun assemblies can include other apparatus for forming perforations, including, for example, mechanical perforation apparatus. In the illustrated embodiment, assembly 150 includes three perforation gun subassemblies (158*a*, 158*b*, and 158*c*); other embodiments can include a greater or lesser number of perforation gun subassemblies.

Figure 1B:
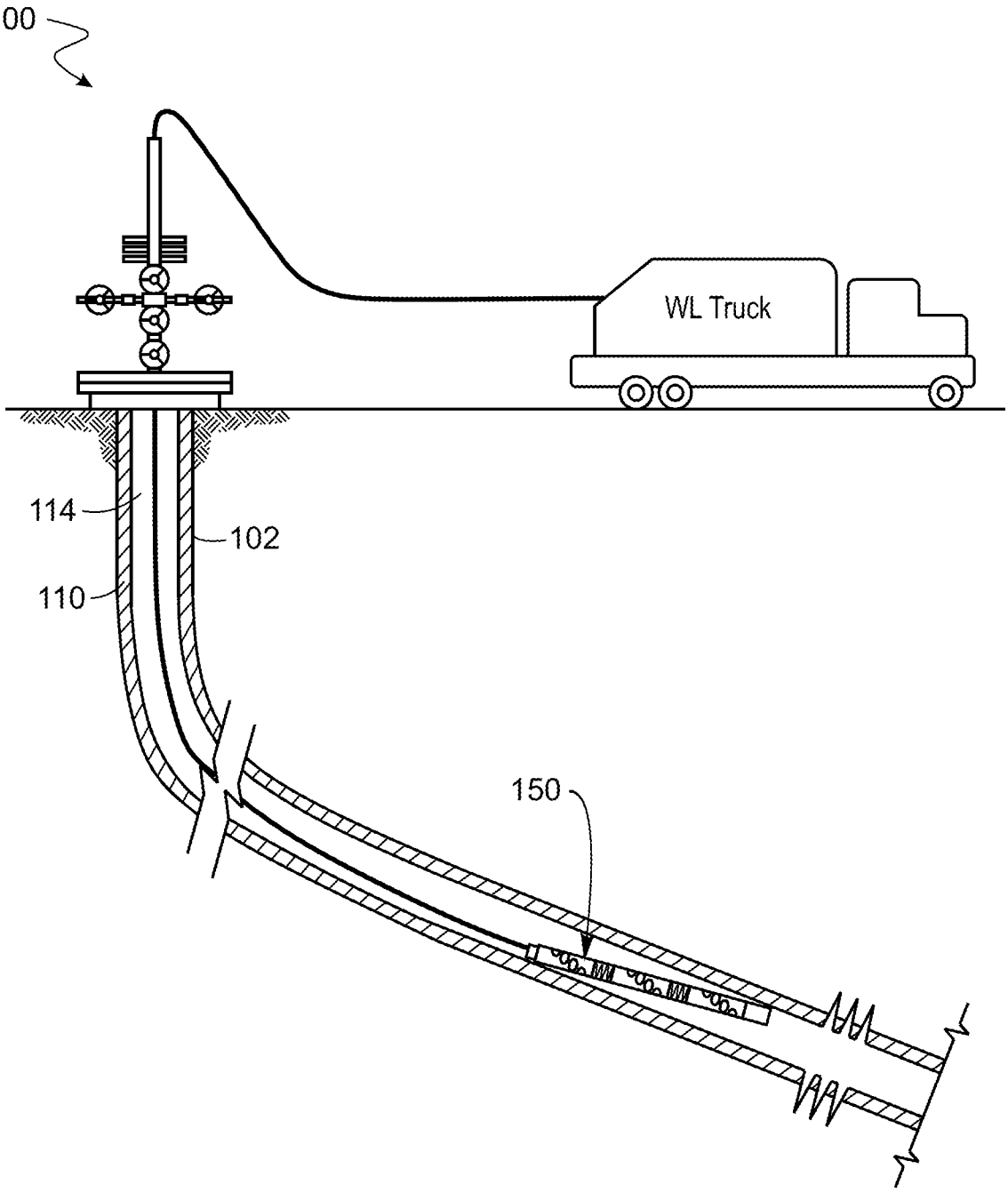
Figure 1C:
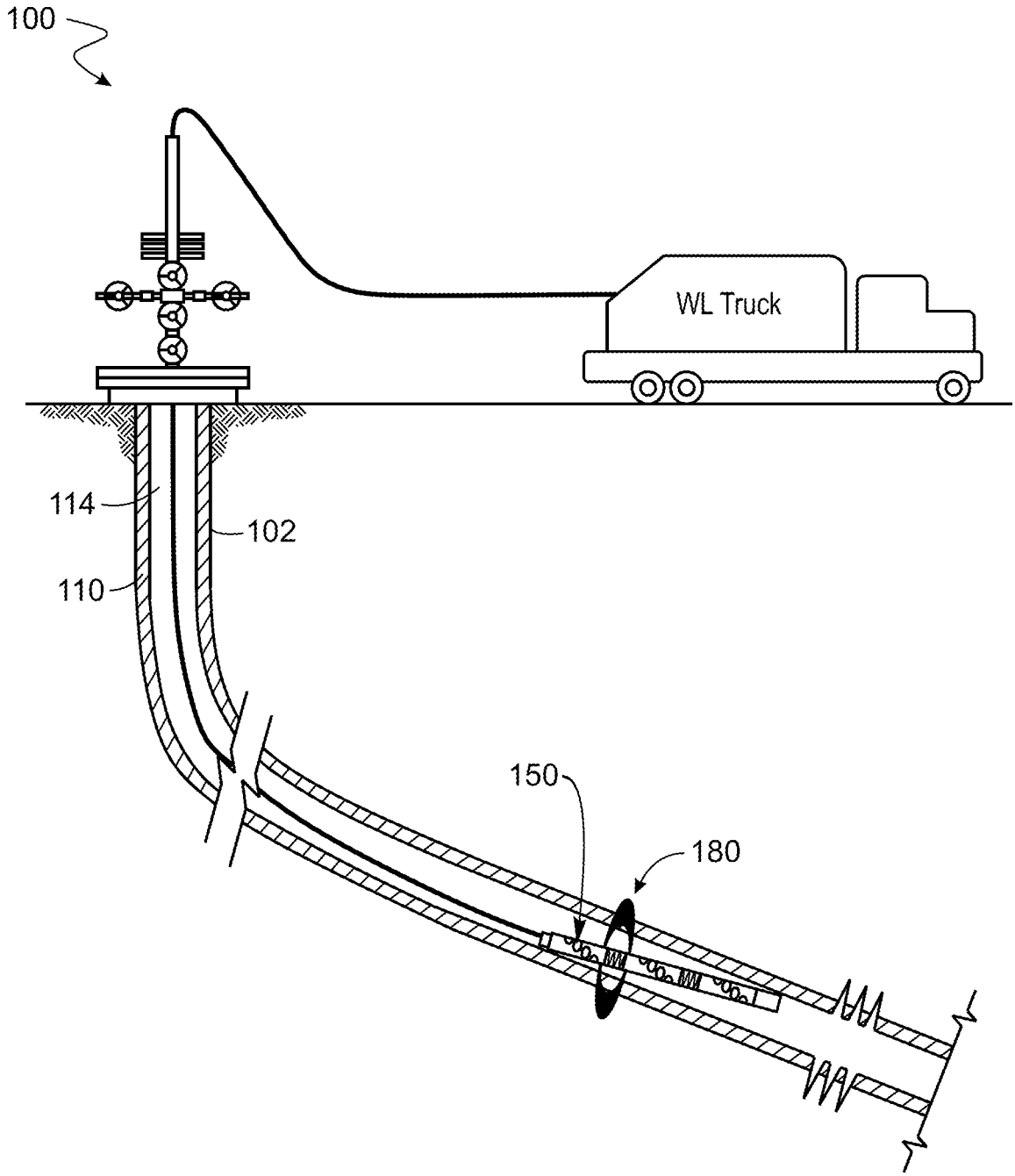
Figure 1D:
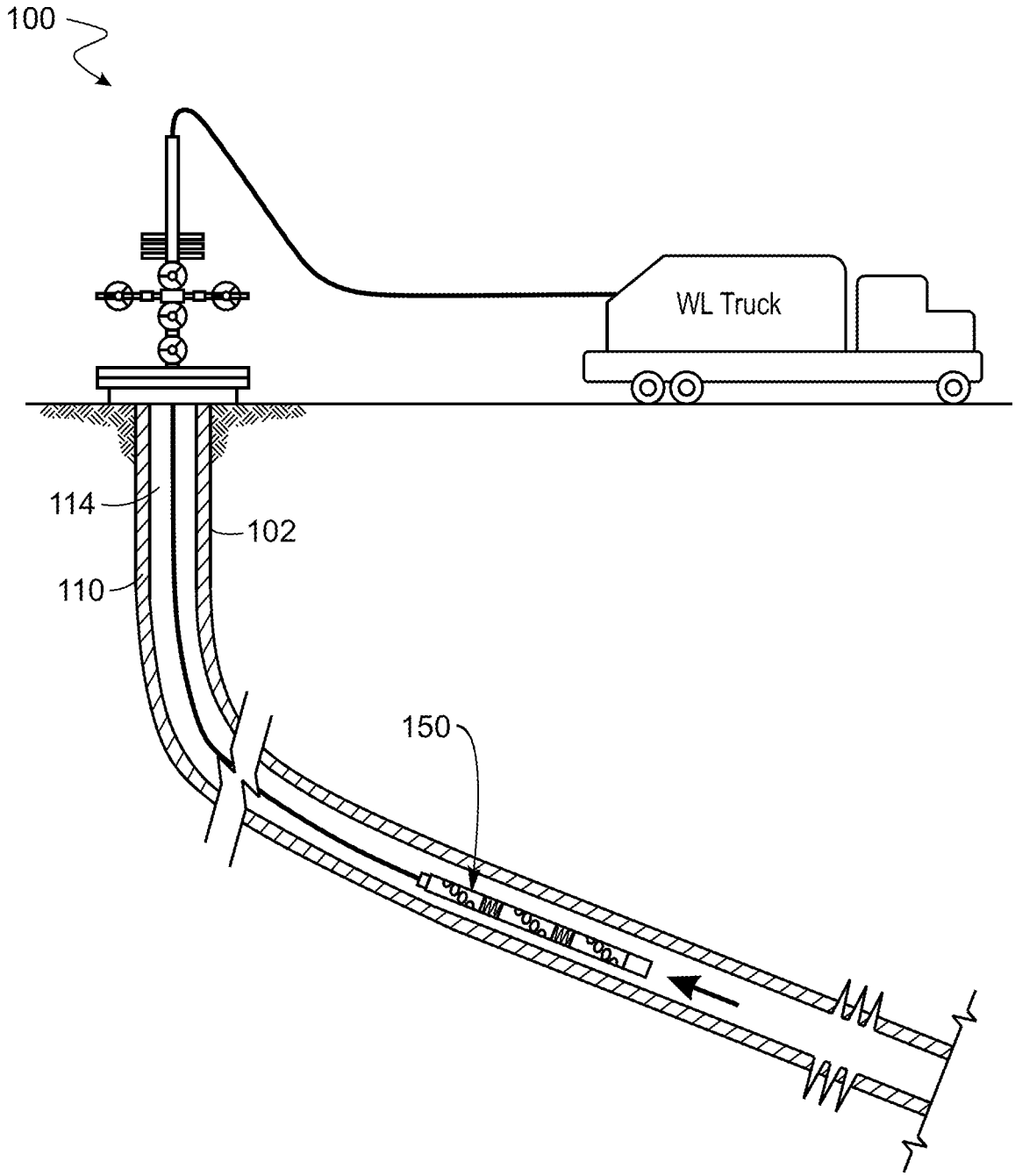

Prior to, during, or after perforation operations, as perforation assembly 150 is translated up or down the wellbore (for example, in an uphole direction by pulling on conveyance 154 or downhole direction due to gravity), the assembly can become stuck by, for example, lodging against the walls of the casing or against debris within the wellbore, as shown in FIG. 1B. Such sticking or lodging can also be due to premature setting of a frac plug (not released from the wireline bottom-hole assembly), diameter increase of the wireline perforating guns, wellbore deformation (for example, due to the perforation operations), or other reasons. Shock-wave generation subassemblies 160*a* and 160*b* can each comprise a housing and an explosive material (such as a length of detonation cord) within an interior volume. System 100 can be configured such that the explosive material within them can be selectively detonated in response to an electric current or other signal from control system 160, and configured such that detonation of the explosive material within them does not cause detonation of any shaped explosive perforation charges within the perforation gun subassemblies. As shown in FIG. 1C, the explosion from the explosive material within a shock-wave generation subassembly can generate a shock wave 180, causing the assembly 150 to dislodge and freeing it from the stuck position. As shown in FIG. 1D, once freed, assembly 150 can be retrieved or otherwise translated uphole or downhole.

In the illustrated embodiment, assembly 150 includes two shock-wave generation subassemblies (160*a* and 160*b*); other embodiments can include a greater or lesser number of shock-wave generation subassemblies. In some embodiments, each of the shock-wave generation subassemblies can include its own detonator, such the explosive charges within the respective subassemblies can be detonated together simultaneously or at different times. For example, upon becoming stuck, only one (or another subset) of the shock-wave generation subassemblies can be initially detonated. If such initial detonation is not successful in causing the assembly to become unstuck, or if the assembly is freed but becomes stuck again at a different location, one or more of the other shock-wave generation subassemblies can be detonated as necessary. In some embodiments, only a single detonator is used for multiple charges.

Figure 2:
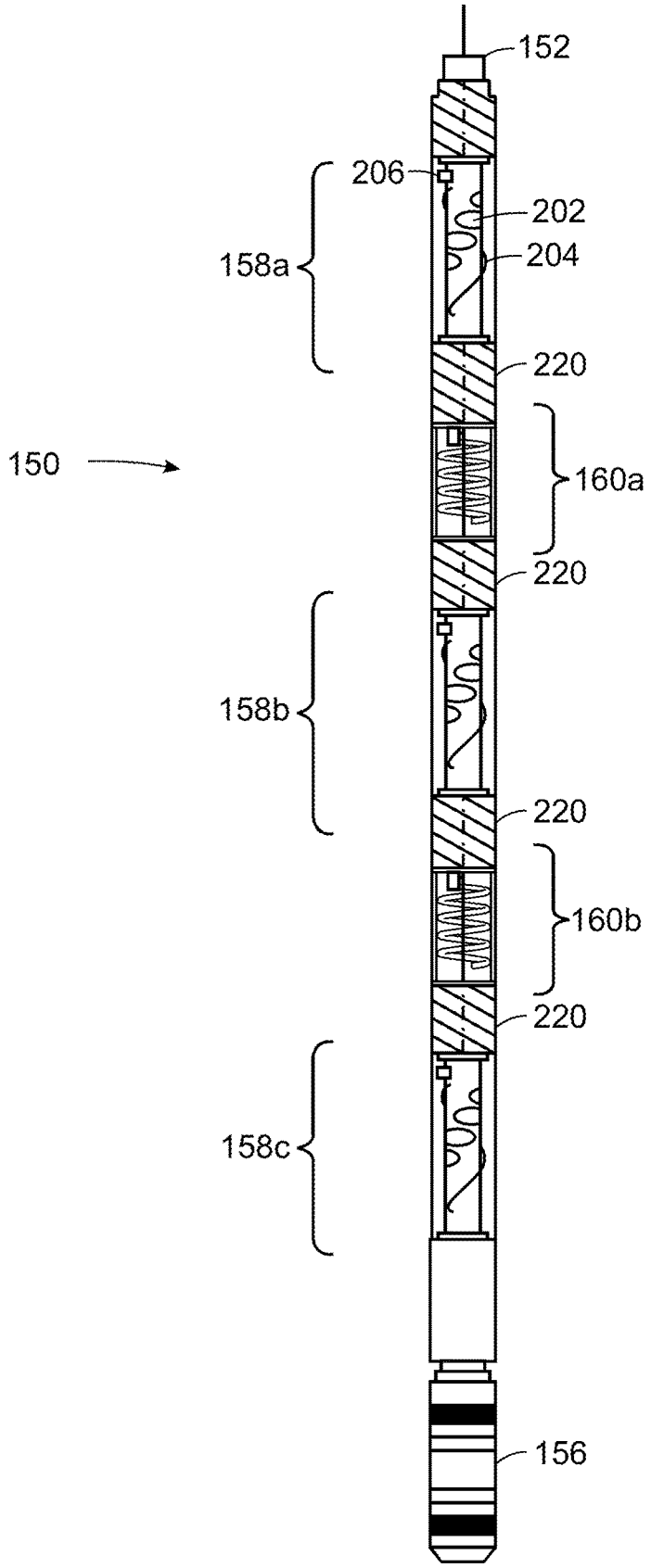
FIG. 2 is a schematic illustration of wireline perforation string in accordance with some embodiments of the present disclosure.

FIG. 2 illustrates assembly 150 in greater detail in accordance with an embodiment of the present disclosure. As shown in FIG. 2, in the illustrated embodiment, each of the perforation gun subassemblies 158*a*, 158*b*, and 158*c* is a separate sub connected via thread ends at their uphole and downhole ends to connection subs 220, which in turn are connected to other components of the assembly. Each includes one or more shaped explosive perforation charges 202 configured in a spiral and connected to a respective length of detonating cord 204 configured to fire the charges when detonated. In the illustrated embodiment, each subassembly includes a separate detonator 206 which can be activated via an electric current or other control signal received via one or more electric cables within wireline conveyance 154. The system can be configured such that all of the detonators in all of the gun assemblies can fire simultaneously, or fire separately (for example, to perforate different locations separated by a distance along the wellbore.

Figure 3:
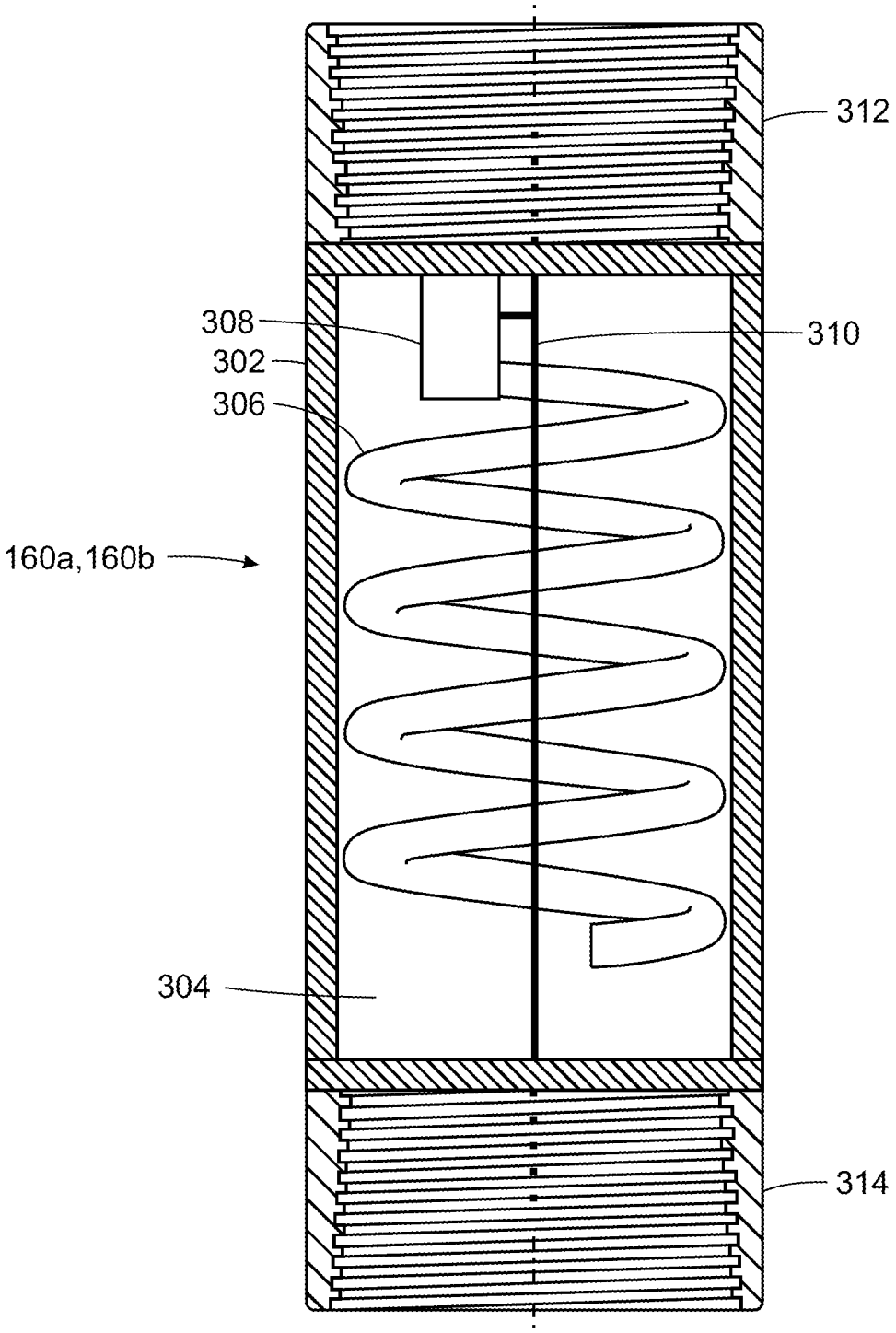
FIG. 3 is a schematic illustration of shock-wave generation sub in accordance with some embodiments of the present disclosure.

Likewise, in the embodiment shown in FIG. 2, and as illustrated in greater detail in FIG. 3, each of the shock-wave subassemblies 160*a* and 160*b* is a separate sub attachable via threaded connections at their respective uphole end 312 and downhole end 314 to one or more of the perforation gun subassemblies (either directly attachable or, as shown in FIG. 2, attachable via connection subs 220, which in turn are connected to other components of the assembly). Each includes a housing 302 enclosing an interior volume 304. An electric cable 310 (which can be carried by conveyance 154) connects to a detonator 308, which can detonate the length of detonating cord 306 in response to an electric current or other signal transmitted via cable 310 to the detonator. In other embodiments, the shock-wave subassembly can include a different type of explosive material, instead of (or in addition to) detonating cord 306. In the illustrated embodiment, each subassembly includes a separate detonator 308 which can be activated via an electric current or other control signal received via one or more electric cables within wireline conveyance 154. The system can be configured such that all of the detonators in all of the shock-wave subassemblies can fire simultaneously or fire separately, as described above.

Detonating cord 306 in the illustrated embodiment is in the form a helical spiral, which allows a greater amount of explosive material for a given length of the sub than if the cord were a straight length of cord extending from the uphole end of the sub to the downhole end. As described in greater detail below, the sub can be configured such that a detonation of the detonating cord in the shock-wave generation subassembly does not cause detonation of any shaped explosive perforation charges. In this way, shock-wave generation and the resulting dislodgement as a separate step during well operations, for example, when attempting to raise or lower the assembly before or after perforation operations, or between perforation operations occurring at different downhole locations. In other embodiments, detonating cord 306 can be a straight length of cord, a zig-zag configurations, or other suitable shapes or configurations, and can have a greater or lesser number of turns and/or a greater or lesser pitch than as shown in FIG. 2 depending on operational needs.

Housing 302 at least partially isolates detonation cord 306 from the perforation gun subassemblies, and detonation cord 306 is separated from (and not continuous with or operatively connected to) detonating cord 204 of the perforation gun subassemblies. With housing 302 and the other components of the shock-wave subassembly so configured, detonation of the detonating cord in the shock-wave generation subassembly does not cause detonation of any detonation cord of the perforation gun subassemblies or of any shaped explosive perforation charges. Housing 302 can be constructed of the same or different material as the housings of the perforating guns, and thickness and kind of housing material, detonators, and other components can be chosen so as to withstand the shockwaves without damage to the housing, the internal components of shockwave subassemblies, the perforation gun subassemblies, or the rest of assembly 150. In some embodiments, housing 302 can include vents to allow some portions of the gas and other materials to exit the subassembly so as to prevent such damage. In other embodiments, housing 302 is constructed so as to have sufficient strength to withstand the explosive gases without any need for such vents.

In the illustrated embodiment, housing 302 is substantially cylindrical and has an outer diameter that is substantially the same as the diameter of the one or more perforation gun subs, and the shock-wave generation subs and the perforation gun assemblies are aligned in sequence with their central axes parallel with the central axis of the wellbore.

Figure 4:
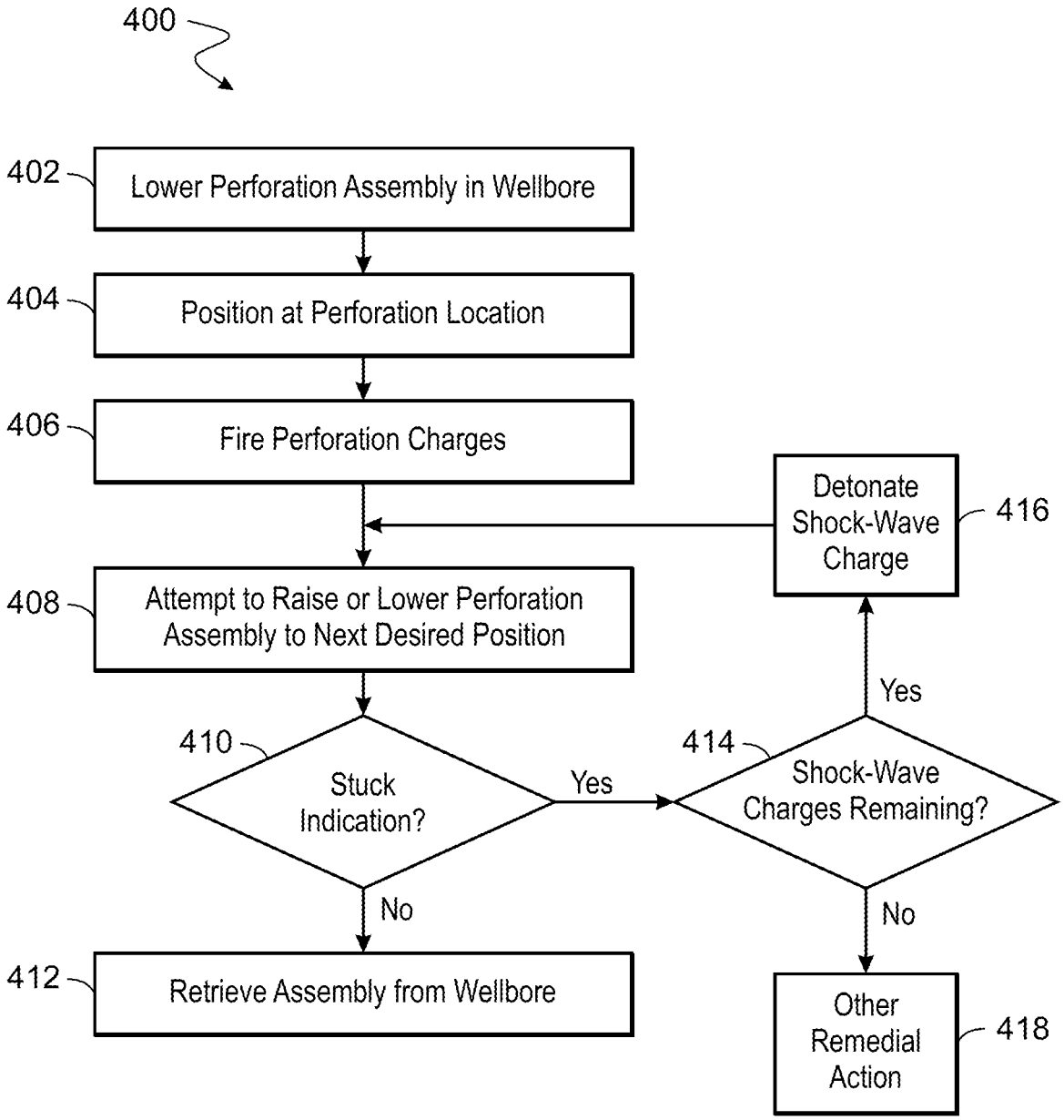
FIG. 4 is a process flow diagram of a method for freeing a stuck wireline assembly in accordance with some embodiments of the present disclosure.

FIG. 4 is a process flow diagram of a method 400 for dislodging and thereby freeing a stuck wireline assembly in accordance with some embodiments of the present disclosure. Method 400 is described in relation to a wireline perforation assembly; however, aspects of the present disclosure may be used for other kinds of wireline assemblies. Method 400 begins at step 402 in which a perforation assembly is disposed in a wellbore. At step 404, the assembly is lowered and/or raised so as to be positioned a desired perforation location. At step 406, the perforation charges of the perforation assembly are detonated as per normal perforation procedures to form production perforations in the wall of the wellbore.

At step 408, the operator attempts to raise or lower the assembly to another desired location. If the assembly travels freely (i.e., if there is no indication of the assembly being stuck as per step 410), then operations continue as normal until at step 412 the assembly is retrieved from the wellbore.

If, at step 410, the operator receives and indication that the assembly is lodged or stuck in the wellbore (as indicated by, for example, an increase in tension in the wireline conveyance) and, if at step 414 the operator determines that there are shock-wave charges remaining (for example, shock-wave subassemblies in which the detonation cord has not yet been detonated) then, at step 416, one or more of the remaining shock-wave charges is detonated, generating shock waves without detonating any shaped explosive perforation charges. After detonation, the method returns to step 410. If at step 410 the operator receives no additional indication of the assembly being stuck (i.e., the shock waves have freed or dislodged the stuck assembly), then operations continue through retrieval step 412. If, after detonation, the operator at step 412 receives an indication that the assembly remains stuck at the same location or at a subsequent location upon further raising or lowering of the assembly, then the method proceeds again to step 414, and this cycle continues until all shock-wave charges have been detonated. If at step 414 there are no remaining shock-wave charges, then further remedial action can be taken to free the assembly, such as the deployment of a jar or fishing apparatus.

In some embodiments, the perforation, stuck indication, and shock-wave detonation steps can occur in a different order. For example, the stuck indication can occur before a perforation detonation occurs (in which case the shock-wave charges can be detonated at a suitable time before perforation), or between sequential perforation detonations done at different depths within the wellbore (in which case the shock-wave charges can be detonated in sequence or simultaneously at a suitable time between perforations).

The term "uphole" as used herein means in the direction along a wellbore from its distal end towards the surface, and "downhole" as used herein means the direction along a wellbore from the surface towards its distal end. A downhole location means a location along a wellbore downhole of the surface.

What is claimed is:

1. A wireline perforation assembly configured to be disposed in a wellbore, the assembly comprising:

one or more perforation gun subassemblies, each comprising one or more shaped explosive perforation charges configured to, when detonated, form a perforation in a wall of the wellbore;

shock-wave generation subassemblies, wherein at least one of the shock-wave generation subassemblies is positioned above at least one of the one or more perforation gun assemblies such that a downhole end of at least one of the shock-wave generation subassemblies attached to an uphole end of at least one of the one or more perforation gun subassemblies, the at least one shock-wave generation subassembly comprising a housing and a length of detonation cord within an interior volume defined at least in part by the housing, the housing at least partially isolating the length of detonation cord from the at least one perforation gun subassembly and configured such that a detonation of the detonating cord within the interior volume generates shock waves of sufficient strength to free the one or more perforation gun assemblies from a stuck position and does not cause detonation of any shaped explosive perforation charges of the at least one perforation gun subassembly.

2. The wireline perforation assembly of claim 1, wherein the assembly is configured such that the shock waves generated by the detonation of the detonating cord in the at least one shock-wave generation subassembly can dislodge the assembly from a stuck position in the wellbore.

3. The wireline perforation assembly of claim 1, wherein the length of detonation cord within the interior volume comprises a helical spiral of detonation cord.

4. The wireline perforation assembly of claim 1, wherein the at least perforation gun subassembly and the at least one shock-wave generation subassembly are threaded subs.

5. The wireline perforation assembly of claim 1, wherein the housing is substantially cylindrical and wherein an outer diameter of the housing is substantially the same as the diameter of the one or more perforation gun subs.

6. The wireline perforation assembly of claim 1, further comprising a detonator configured to, in response to a control signal, detonate the detonating cord in the at least one of the shock-wave generation subassembly, without detonating any of the one or more shaped explosive perforation charges.

7. The wireline perforation assembly of claim 6, wherein the length of detonating cord in the at least one shock-wave generation subassembly is a first length of detonating cord, the detonator comprises a first detonator, and the control signal comprises a first control signal, and wherein the at least one of the perforation gun subassemblies further comprises a second length of detonating cord and a second detonator, the second detonator configured to, in response to a second control signal, detonate the second length of detonating cord, thereby detonating at least one of the one or more shaped explosive perforation charges.

8. The wireline perforation assembly of claim 1, wherein an uphole end of the assembly is configured to be attached to a wireline conveyance.

9. The wireline perforation assembly of claim 1, wherein an uphole end of the at least one shock-wave generation subassembly is attached to a downhole end of a second one of the one or more perforation gun subassemblies.

10. A shock-wave generation sub comprising:

an uphole end and a downhole end, the downhole end of the shock-wave generation sub attachable to an uphole end of a perforation gun subassembly of a wireline perforation assembly, wherein the wireline perforation assembly is configured to be disposed in a wellbore and the perforation gun subassembly comprises one or more shaped explosive perforation charges configured to, when detonated, form a perforation in a wall of the wellbore;

a housing defining an interior volume; and a length of detonation cord positioned above the perforating gun subassembly within the interior volume, wherein the housing at least partially isolates the length of detonation cord from the perforation gun subassembly and wherein the shock-wave generation sub is configured such that a detonation of the detonating cord within the interior volume generates shock waves of sufficient strength to free the one or more perforation gun assemblies from a stuck position and does not cause detonation of any of the one or more shaped explosive perforation charges of the perforation gun subassembly.

11. The shock-wave generation sub of claim 10, wherein at least one of the uphole end or the downhole end are threaded.

12. The shock-wave generation sub of claim 10, wherein the shock-wave generation sub is configured such that the shock waves generated by the detonation of the detonating cord in the shock-wave generation sub can dislodge the wireline perforation assembly from a stuck position in the wellbore.

13. The shock-wave generation sub of claim 10, wherein the length of detonation cord within the interior volume comprises a helical spiral of detonation cord.

14. The shock-wave generation sub of claim 10, wherein the housing is substantially cylindrical and an outer diameter of the shock-wave generation sub is substantially the same as an outer diameter of the perforation gun subassembly.

15. The shock-wave generation sub of claim 11, further comprising a detonator configured to, in response to a control signal, detonate the detonating cord, without detonating any of the one or more shaped explosive perforation charges.

16. A method comprising:

detonating one or more shaped explosive perforation charges of a wireline perforation assembly positioned within a wellbore via a wireline conveyance, thereby forming a perforation in a wall of the wellbore, the wireline perforation assembly comprising a first shock-wave generation subassembly and a second shock-wave generation subassembly, each of the first shock-wave generation subassembly and the second shock-wave generation subassembly comprising a housing at least partially isolating a length of detonation cord within its respective interior volume;

detonating, as a first instance of detonation and in response to a first indication that the wireline perforation assembly is in a stuck position in the wellbore, a length of detonation cord within an interior volume of the first shock-wave generation subassembly, thereby generating shock waves without detonating any shaped explosive perforation charges of the wireline perforation assembly;

detonating, as a second instance of detonation of detonation cord and in response to a second indication that the wireline perforation assembly is in the stuck position in the wellbore, a length of detonation cord within an interior volume of the second shock-wave generation subassembly, thereby generating further shock waves without detonating any shaped explosive perforation charges of the wireline perforation assembly.

17. The method of claim 16, wherein the shock waves from the second instance of detonation free the wireline perforation assembly from the stuck position.

18. The method of claim 16, wherein the length of detonation cord within the interior volume of each of the first shock-wave subassembly and the second shock-wave subassembly comprises a helical spiral of detonation cord.

19. The method claim 16, further comprising retrieving the assembly with the wireline conveyance after the second instance of detonating.

20. The method of claim 16, further comprising detonating one or more shaped explosive perforation charges after the second instance of detonation of detonation cord in the second shock-wave generation subassembly.

21. The method of claim 16, wherein the first instance of detonating is by a detonator within the first shock-wave generation subassembly and the second instance of detonating is by a detonator within the second shock-wave generation subassembly.

* * * * *